US009333661B1

(12) United States Patent
Nguyen

(10) Patent No.: US 9,333,661 B1
(45) Date of Patent: May 10, 2016

(54) FOOD SLICING APPARATUS

(71) Applicant: Hien Nguyen, Ladylake, FL (US)

(72) Inventor: Hien Nguyen, Ladylake, FL (US)

( * ) Notice: Subject to any disclaimer, the term of this patent is extended or adjusted under 35 U.S.C. 154(b) by 0 days.

(21) Appl. No.: 14/732,694

(22) Filed: Jun. 6, 2015

(51) Int. Cl.
*B26B 29/06* (2006.01)
*B26D 3/28* (2006.01)

(52) U.S. Cl.
CPC ..... *B26B 29/063* (2013.01); *B26D 2003/285* (2013.01); *B26D 2003/286* (2013.01)

(58) Field of Classification Search
CPC . Y10T 83/9493; Y10T 83/949; Y10S 83/932; B26D 2003/285–2003/288; B26D 3/28; B26D 3/283; B26D 1/02; B26D 1/03; B26B 28/063; B26B 29/063
USPC ..... 30/278, 279.2, 279.6, 280, 283; 279/8, 279/87, 141
See application file for complete search history.

(56) References Cited

U.S. PATENT DOCUMENTS 44,547 A * 10/1864 Morahan ..... B26D 1/0006 83/856
48,118 A * 6/1865 Walker ..... B26D 1/0006 30/284
158,830 A * 1/1875 Buterworth ..... B26B 5/006 30/162
221,436 A * 11/1879 Andrews ..... B26D 1/0006 83/856
824,766 A * 7/1906 Weaver ..... B26D 3/283 83/699.51
1,259,477 A * 3/1918 Beard ..... B23D 51/14 30/278
4,281,460 A * 8/1981 Harris ..... A47J 43/25 30/278
4,570,519 A * 2/1986 Motosko, II ..... B26B 5/007 30/283
D410,366 S * 6/1999 Chiasson ..... D7/673
6,796,033 B2 * 9/2004 Owoc ..... B26B 5/001 30/162

* cited by examiner

*Primary Examiner* — Stephen Choi
*Assistant Examiner* — Evan MacFarlane
(74) *Attorney, Agent, or Firm* — Massinger Law Offices

(57) ABSTRACT

An apparatus for slicing fruits, vegetables and other food items into slices of varying thickness is designed to work in combination with the user's own kitchen knives rather than having a preinstalled fixed blade of limited operable life span. The apparatus includes means for properly orienting and securing knife blades of a variety of shapes and sizes within the apparatus as well as safety features to prevent accidental injury.

16 Claims, 9 Drawing Sheets

FOOD SLICING APPARATUS

FIELD OF THE INVENTION

The subject invention relates to food preparation devices generally, and more particularly to a hand-held apparatus for safely and efficiently cutting food articles such as fruits and vegetables into slices.

BACKGROUND OF THE INVENTION

Fruit and vegetable slicers of the hand-held and manually operated variety provide an efficient means of quickly cutting fruits and vegetables into slices for immediate consumption or use in cooking. Such slicers typically comprise a pivotable slide plate across which the food article is passed reciprocally while striking a transverse cutting blade for cutting the article into slices.

While most such slicing devices are effective in carrying out their primary purpose, namely providing a means for rapidly slicing food articles with a minimum of effort, they also commonly suffer from similar shortcomings and limitations. For example, a common shortcoming is that the cutting blade, which is not removable, ultimately becomes dull and/or rusted resulting in the entire apparatus going unused or being discarded. Replacing the apparatus with a new one with any frequency becomes cost prohibitive often resulting in the user performing the task manually with a kitchen knife. This, of course, is undesirable because the task is time and labor intensive.

Another problem associated with slicers of the prior art is that the pivotable slide plate on which the article to be cut is guided sags when pressure is exerted on the article during the sliding process. This often results in the creation of slices that are not uniform in thickness, and in some instances, results in breakage of the apparatus because the height adjustable slide plate is not properly supported.

Accordingly, there is a need for a slicing apparatus for fruits and vegetables wherein the cutting blade is easily replaceable and the height-adjustable slide plate is adequately supported.

SUMMARY OF THE INVENTION

The above referenced objects and advantages are achieved by the subject invention which, very generally, is a slicing apparatus adapted for manual use in both home and commercial kitchens for slicing fruits, vegetables and other food items into slices of varying thickness. The food processing apparatus of the subject invention is designed to work in combination with the user's own kitchen knives rather than having a preinstalled fixed blade of limited operable life span. The apparatus includes means for properly orienting and securing knife blades of a variety of shapes and sizes within the apparatus as well as safety features to prevent accidental injury. A pivotable slide plate supports the food items to be sliced, and the slide plate is supported by a transverse support member that prevents it from sagging to assure consistent slice thickness and to mitigate against breakage that occurs in manual slicing apparatus of the prior art. The support member also serves as the height adjustment means for the pivotable slide plate for adjusting the height of the slide plate relative to the cutting blade. In another embodiment, the apparatus includes mounting means for mounting the apparatus across the top of bowls and the like for collection of the food slices.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technica disclosure of the application. The abstract is neither intended to define the invention of the application, which is measured by the claims, nor is it intended to be limiting as to the scope of the invention in any way.

It is, therefore, a primary object of the subject invention to provide a manually operated kitchen apparatus for safely slicing fruits, vegetables and other foods into slices of varying thickness, the apparatus being designed to work in combination with a variety of differently sized and shaped kitchen knives.

Another primary object of the subject invention is to provide a kitchen apparatus for safely slicing fruits, vegetables and other foods into slices of varying thickness, the apparatus including a food support platform or "sliding tray" that is both height adjustable and adequately supported to prevent sagging or breakage.

It is another primary object of the subject invention to provide a slicing apparatus that is fabricated from materials that are durable, corrosion-resistant, and non-absorbent.

Another object of the subject invention is to provide a slicing apparatus that is fabricated from materials that are sufficient in weight and thickness to withstand repeated warewashing.

Another object of the subject invention is to provide a slicing apparatus that is fabricated from materials that may be finished to possess smooth, easily cleanable surfaces.

Still another object of the subject invention is to provide a slicing apparatus that is fabricated from materials that are resistant to pitting, chipping, crazing, scratching, scoring, distortion and decomposition.

Still another object of the subject invention is to provide a slicing apparatus designed with limited sharp internal angles, corners, and crevices which could retain moisture, bacteria, molds and other deleterious substances.

Another object of the subject invention is to provide a slicing apparatus that is relatively simple in design and therefore capable of rapid construction at relatively low costs.

These together with other objects of the invention, along with the various features of novelty which characterize the invention, are pointed out with particularity in the claims annexed to and forming a part of this disclosure. For a better understanding of the invention, its advantages and the specific objects attained by its uses, reference should be had to the accompanying drawings and descriptive matter in which there is illustrated a preferred embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENT

Figure 1:
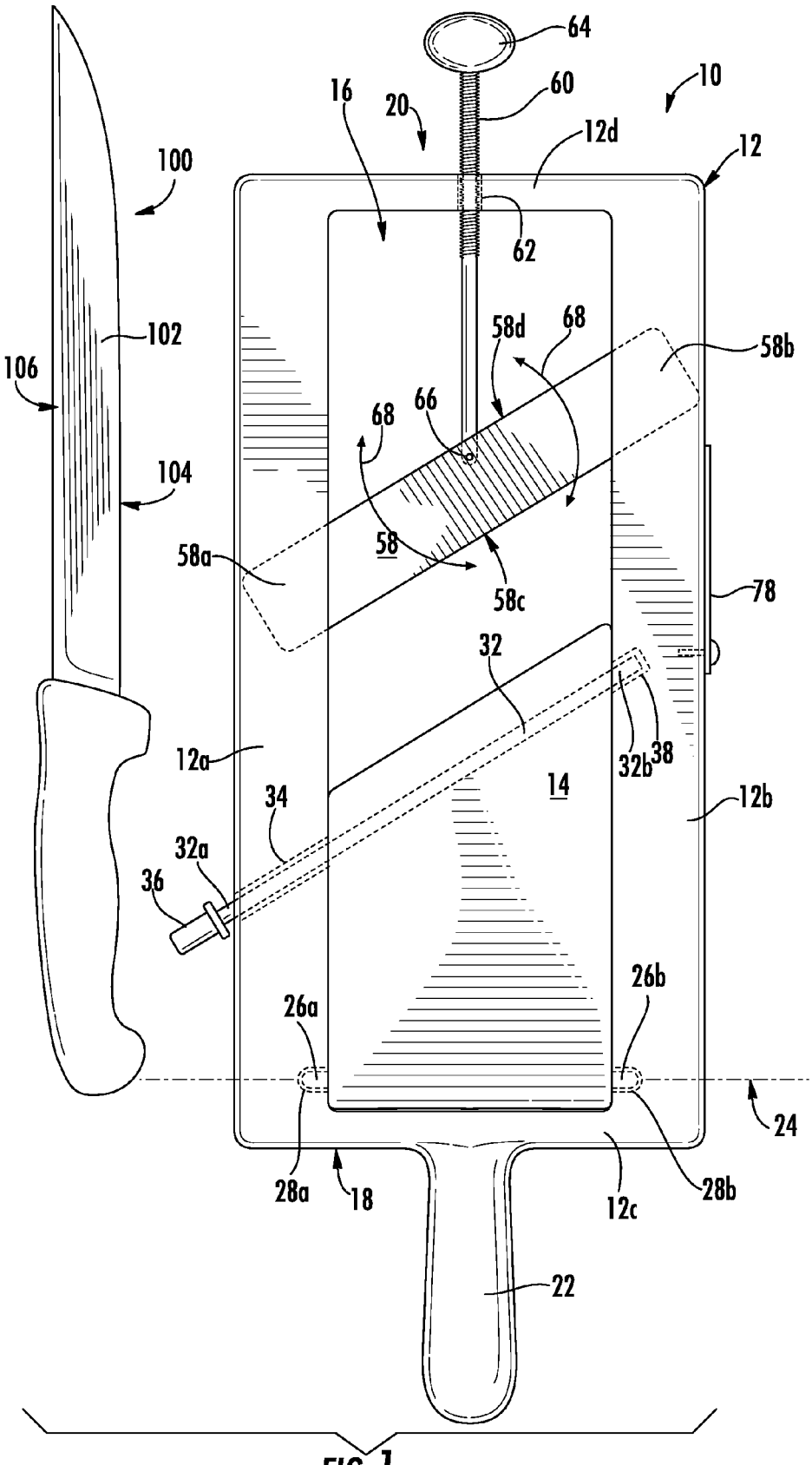
FIG. 1 is a plan view of a preferred embodiment of the subject slicing apparatus shown with a variety of kitchen knives mountable within the apparatus.

At the outset, it should be clearly understood that like reference numerals are intended to identify the same structural elements, portions or surfaces consistently throughout the several drawings figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. In addition, certain terms are used throughout such as "top", "upper", "lower", "bottom", "lateral", and the like. These terms are used in order to establish an effective frame of reference when referring to the accompanying drawings. These terms, however, should not be regarded as limiting with regard to the intended scope of the present invention, except where specifically indicated.

Figure 2:
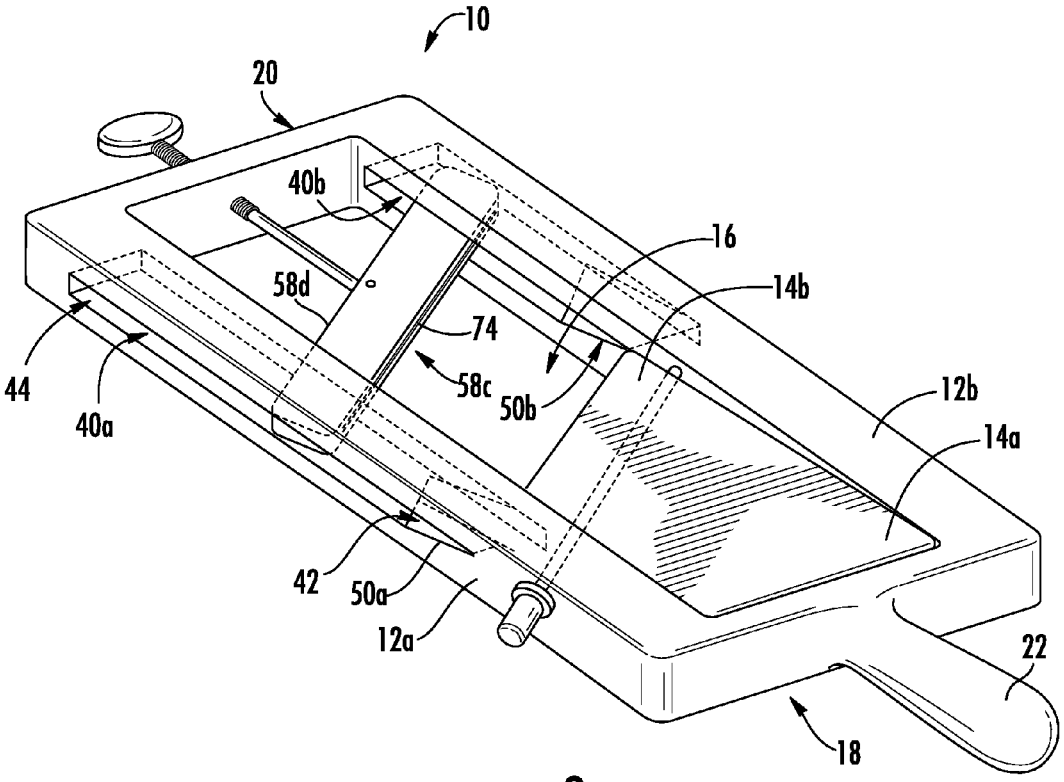
FIG. 2 is a perspective view of the slicing apparatus of FIG. 1.

Reference is made to FIGS. 1 and 2 in which there are illustrated plan and perspective views, respectively, of a preferred embodiment of the subject food slicing apparatus designated generally by reference numeral 10. Slicing apparatus 10 is comprised of four primary components, namely a frame body 12, a food support plate 14 attached to frame body 12 and upon which a food item is supported during the slicing operation, blade receiving means associated with frame body 12 for receiving and transversely positioning a blade 102 of a kitchen knife 100 through frame body 12, and blade securing means for securing the blade 102 within frame body 12.

Figure 8:
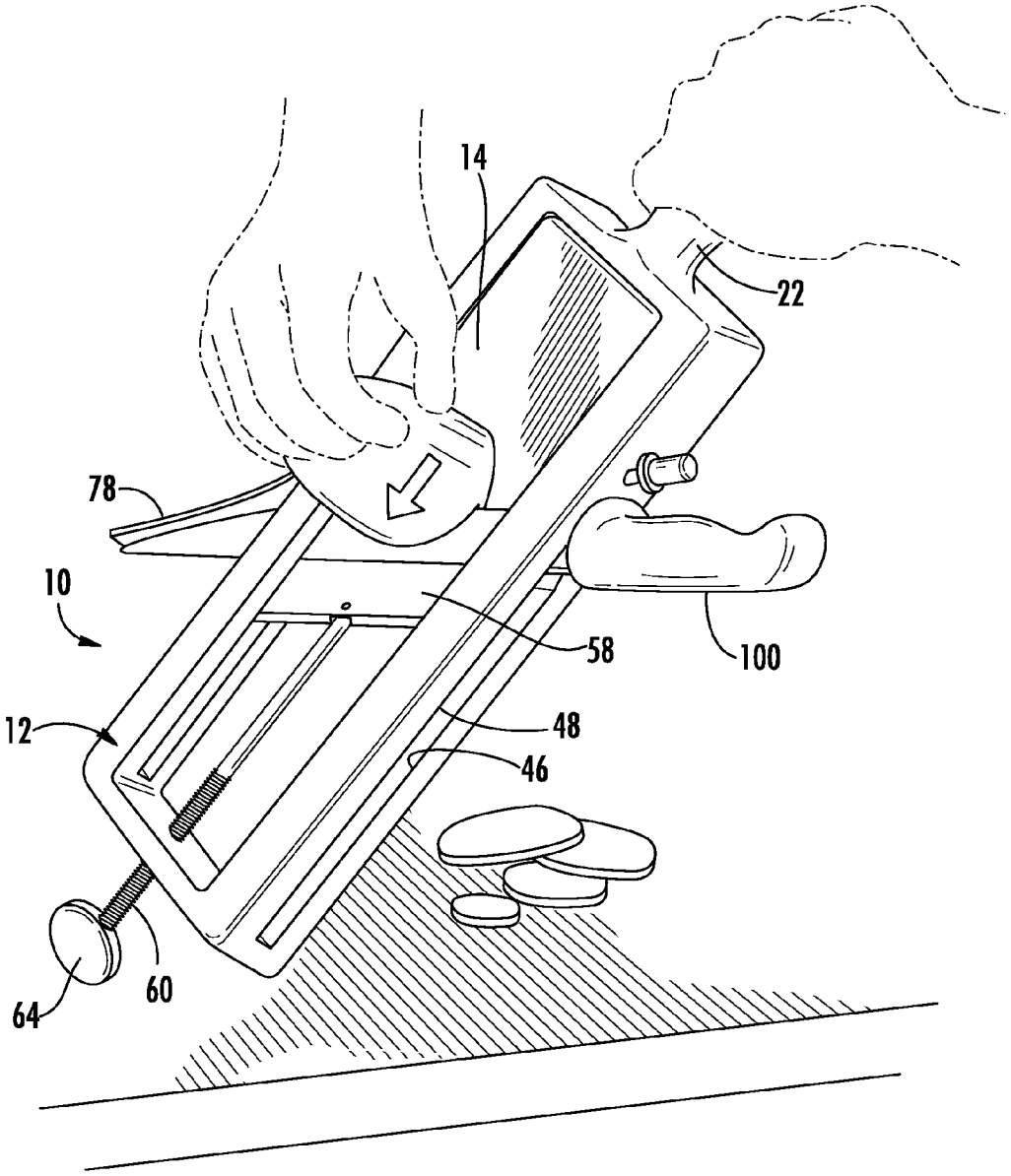
FIG. 8 is a perspective view of the subject slicing apparatus in use with a common kitchen knife.

Frame body 12 is preferably but not essentially of four-sided construction having a pair of parallel longitudinal frame members 12*a*,12*b* joined together at one end by proximal cross member 12*c* and at the opposite end by distal cross member 12*d*. Together, longitudinal frame members 12*a*,12*b*, proximal cross member 12*c* and distal cross member 12*d* define frame opening 16. Frame body 12, therefore, has a proximal end 18 and a distal end 20. A handle 22 is attached to proximal end 18 for handling the apparatus during use as illustrated in FIG. 8. Those skilled in the art will recognize that other types of handles or means for grasping the apparatus may be employed. For instance, in another embodiment, proximal cross member 12*c* may be modified with a horizontal slotted opening (not shown) through which the fingers may be inserted for grasping the slicing apparatus 10 in a design and manner well known in the art.

Figure 6:
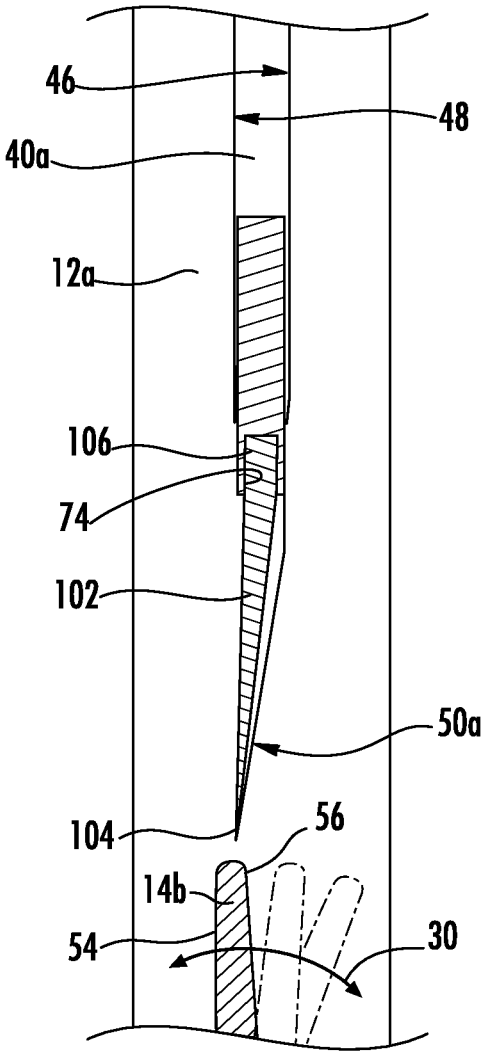
FIG. 6 is an enlarged side sectional view taken along line 6-6 of FIG. 5 and illustrating the orientation of a knife blade relative to the adjustable slide plate.
Figure 7:
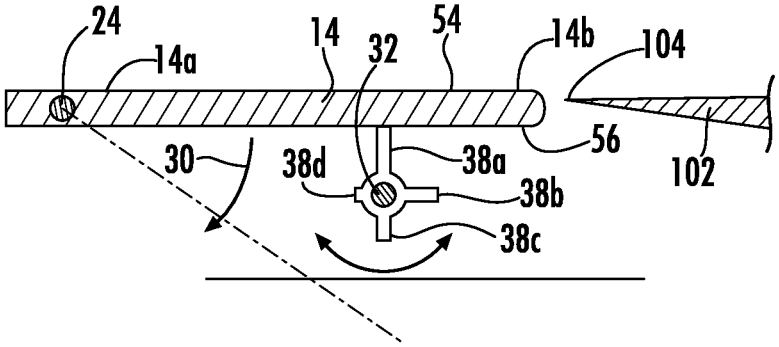
FIG. 7 is an enlarged side sectional view taken along line 7-7 of FIG. 5 and illustrating a slide plate support and height adjustment rod.

Food support plate 14 has a proximal end 14*a* and a distal end 14*b* and occupies a portion of opening 16 at proximal end 18 of apparatus 10. Proximal end 14*a* of food support plate 14 is in near abutting relationship with proximal cross member 12*c* and is preferably pivotally mounted in normally coplanar alignment with frame body 12 and is pivotable about an axis of rotation 24 that is parallel with proximal cross member 12*c*. In one embodiment, support plate 14 includes left and right support pins 26*a,b* projecting laterally from proximal end 14*a* of support plate along axis of rotation 24, the pins being inserted into corresponding left and right bores 28*a,b* disposed within left and right longitudinal members 12*a,b*, respectively, to form a hinge. Here again, those skilled in the art will recognize that other pivotal mounting means may be employed. With additional reference now to FIGS. 6 and 7, it may be appreciated that, once pivotably mounted, food support plate 14 is capable of pivotal rotation about axis of rotation 24 along arc of rotation 30 such that distal end 14*b* of food support plate 14 may be rotated downwardly below the plane of knife blade 102 when mounted within frame body 14 as described below to adjust the thickness of food slices in a manner well known in the art The distal end 14*b* of food support plate 14 is preferably formed at an angle relative to axis of rotation 24 such that food support plate 14 possesses a trapezoidal shape. In order to support the distal end 14*b* of food support plate 14 and to prevent its downward rotation beyond a selected degree of rotation, a transverse support rod 32 extends through transverse bore 34 in left longitudinal member 12*a*, across opening 16 and into at least a portion of right longitudinal member 12*b* to provide a support upon which distal end 14*b* of food support 14 rests under gravity. Support rod 32 includes a first end 32*a* projecting outwardly from left longitudinal member 12*a* a distance sufficient for grasping and rotating the rod and may be adapted with a knob 36 to facilitate turning. Support rod 32 further includes a second end 32*b* that is journaled within an aperture 38 disposed within right longitudinal frame member 12*b*. In order to adjust the angle of rotation of food support plate 14 about axis of rotation 24 and relative to frame body 12, support rod may possess an irregular cross-sectional shape to form a cam upon which food support plate 14 rests. In one embodiment, support rod may have a plurality of radial teeth 38*a,b,c,d* each extending a different distance from its surface. As should be readily understood by those skilled in the art, axial rotation of support rod 32 permits incremental height adjustment of food support plate 14 relative to cutting blade 102 when mounted in the subject food slicing apparatus 10 (FIGS. 6 and 7). In this manner, the versatility of the apparatus is improved to allow slicing of a food product into thin shavings or relatively thick slices.

In another embodiment, support rod 32 can have an eccentric disc or other cross-sectional shape that produces a smooth reciprocating height adjustment when the rod is rotated. Note that the placement of support rod 32 across the entire width of the distal end 14*b* of food support plate 14 will prevent sagging and mitigate against breakage.

With reference now being made in particular to FIG. 2, the remaining two primary components of the subject slicing apparatus 10 will be described, namely blade receiving means associated with frame body 12 for receiving and transversely positioning a blade 102 of a kitchen knife 100 through frame body 12, and blade securing means for securing the blade 102 within frame body 12. With respect to the former, in one embodiment, blade receiving means is comprised of left and right slots 40*a,b*, disposed through the sides of corresponding left and right longitudinal frame members 12*a,b*, respectively, and extending longitudinally from distal cross member 12*d* to the distal end 14*b* of food support plate 14, and sized and shaped to receive axially therethrough the blade portion 102 of a variety of kitchen knives 100 including, but not limited to, boning knives, bread knives, carving knives, cheese knives, chef's knives, clevers, filet knives, pairing knives, santoku knives and steak knives. For operation, the knife blade 102 is inserted axially through left slot 40*a* of left longitudinal frame member 12*a*, across opening 16 and through at least a portion of slot 40*b* of right longitudinal member 12*b* and oriented so that its cutting edge 104 faces proximal end 18 of frame body 12 as best observed in FIG. 3. Thusly positioned, cutting edge 104 is in near abutting relationship with the distal end 14*b* of support plate 14 when the latter is rotated about its axis of rotation to be parallel to the plane of frame body 12. Each slot 40*a,b* has a proximal end 42 located in proximity to the distal end 14*b* of food support plate 14, and a distal end 44 located in proximity to distal end 20 of frame body 12. As best observed in FIG. 4, proximal ends 42 of slots 40*a,b* are tapered upwardly moving from distal end 20 to proximal end 18 from the bottom 46 of each slot to the top 48 thereof to form left and right blade positioning ramps 50*a,b* which serve to properly orient the cutting edge 104 of the inserted knife blade 102 in substantially parallel alignment with, and near abutting relation to, distal edge 52 of food support plate 14. As a safety feature, when support rod 32 is adjusted to place food support plate in a horizontal or "safe" position, ramps 50*a,b* assure that cutting edge 104 is oriented between top surface 54 and bottom surface 56 of food support plate 14 which acts to shield the blade edge and prevent accidental cuts of the user's hands or fingers.

Figure 4:
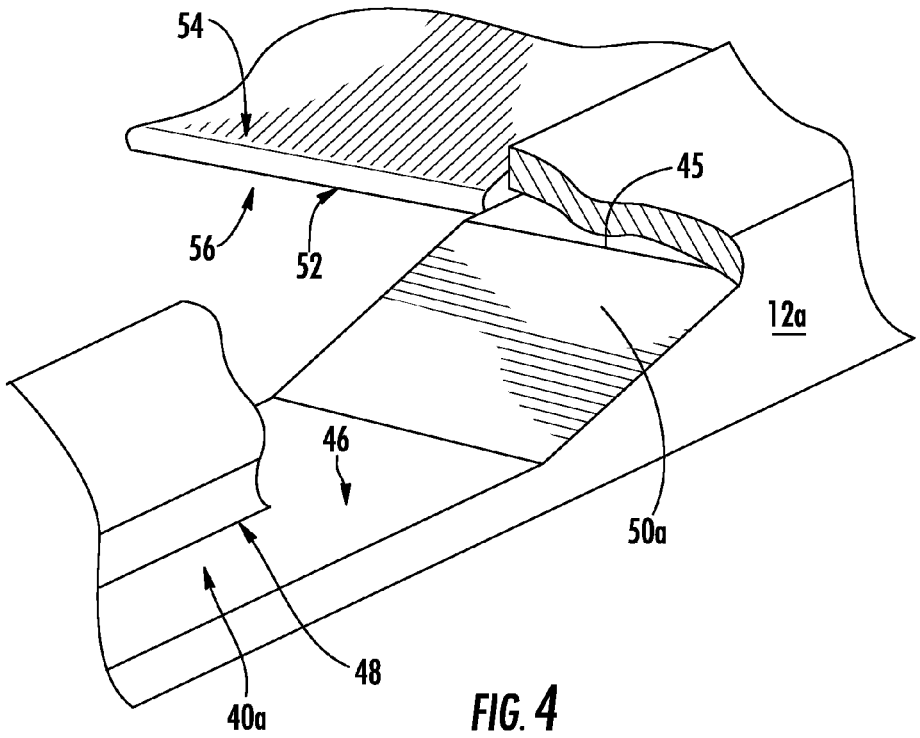
FIG. 4 is a an enlarged view of a knife blade orientation means of the subject slicing apparatus
Figure 5:
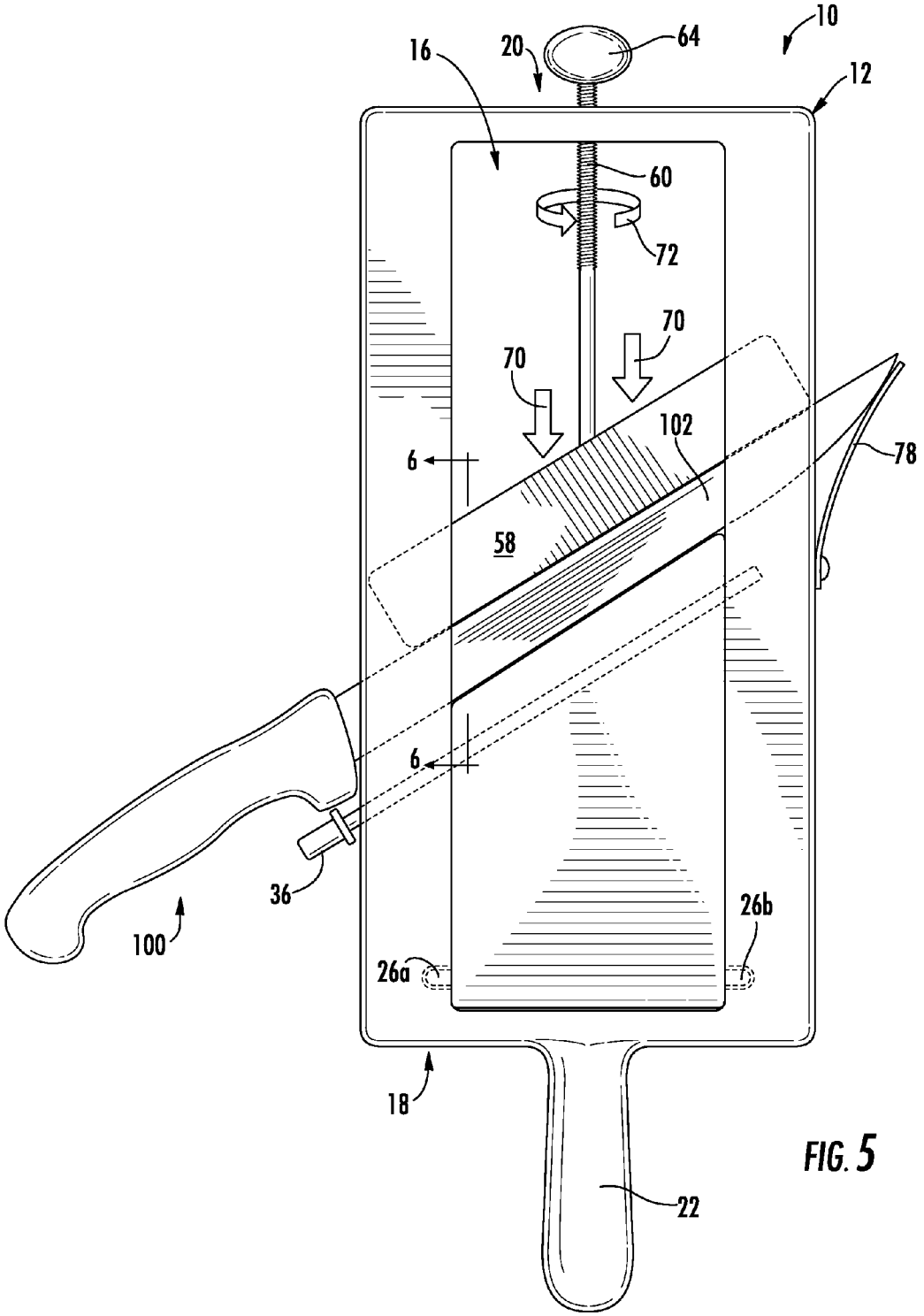
FIG. 5 is a plan view of the slicing apparatus of FIG. 3 with the knife blade locking means shown in a deployed position.

In order to safely secure knife 100 in slicing apparatus 10 blade securing means are provided. In one embodiment, blade securing means comprises transverse member 58 having a left end 58*a* slidably received within left slot 40*a* of left longitudinal frame member 12*a* and a right end 58*b* slidably received within right slot 40*b* of right longitudinal frame member 12*b*. Transverse member 58 further includes a leading edge 58*c* facing the proximal end 18 of frame body 12 and a trailing edge 58*d* facing the distal end 20 of frame body 12. Blade securing means further includes adjustment means for adjusting the position of transverse member 58 proximally and distally within slots 40*a,b*, and, more importantly, for applying a force on transverse member 58 in the proximal direction for biasing leading edge 58*c* against the spine 106 of a blade 102 until blade edge 104 is trapped against left and right blade stops 45 formed by the junction of ramps 5003 and slot tops 48 (FIGS. 4 and 6). In one embodiment, transverse member adjustment means (hereinafter "adjustment means") is comprised of a threaded adjustment rod 60 adjustably received within a reciprocally threaded aperture 62 extending through distal cross member 12*d*, normal to its longitudinal axis Adjustment rod 60 terminates distally in knob 64 to facilitate its rotation within threaded aperture 62, and terminates proximally in connection means for pivotable connection to the midpoint of trailing edge 58*d* of transverse member 58 such that transverse member 58 is permitted to rotate about attachment pin 66 along arc 68 in order that apparatus 10 may accommodate knives having different blade profiles (i.e., different angles of orientation between blade spine 106 and blade cutting edge 104). More specifically, pivotability of transverse member 58 assures that its leading edge 58*c* will always lie flush with the spine 106 of a blade 102 when mounted within the subject slicing apparatus 10, regardless of the angle of orientation of spine 106 relative to cutting edge 104, thereby assuring blade 102 is securely locked in place for use. Attachment pin 66 is perpendicular to axis of rotation 24 of food support plate 14 and is disposed through transverse member 58 and adjustment rod 60 connecting the two together about a common axis of rotation. Referring to FIG. 5 it may be appreciated that rotation of adjustment rod 60 in one direction illustrated by directional arrow 72 causes adjustment rod 60 and the attached transverse member 58 to slide proximally as illustrated by directional arrow 70 within slots 40*a,b* until leading edge 58*e* engages the spine 106 of blade 102. Rotation continues until the blade's cutting edge 104 is biased against blade stops 45 of slots 40*a,b* locking the blade in place. Referring to FIGS. 2 and 6, leading edge 58*c* of transverse member 58 may be adapted with a longitudinal channel 74 sized to receive the spine 106 of the knife blade 102 to provide secure abutting engagement of blade 102 and transverse member 58.

Figure 3:
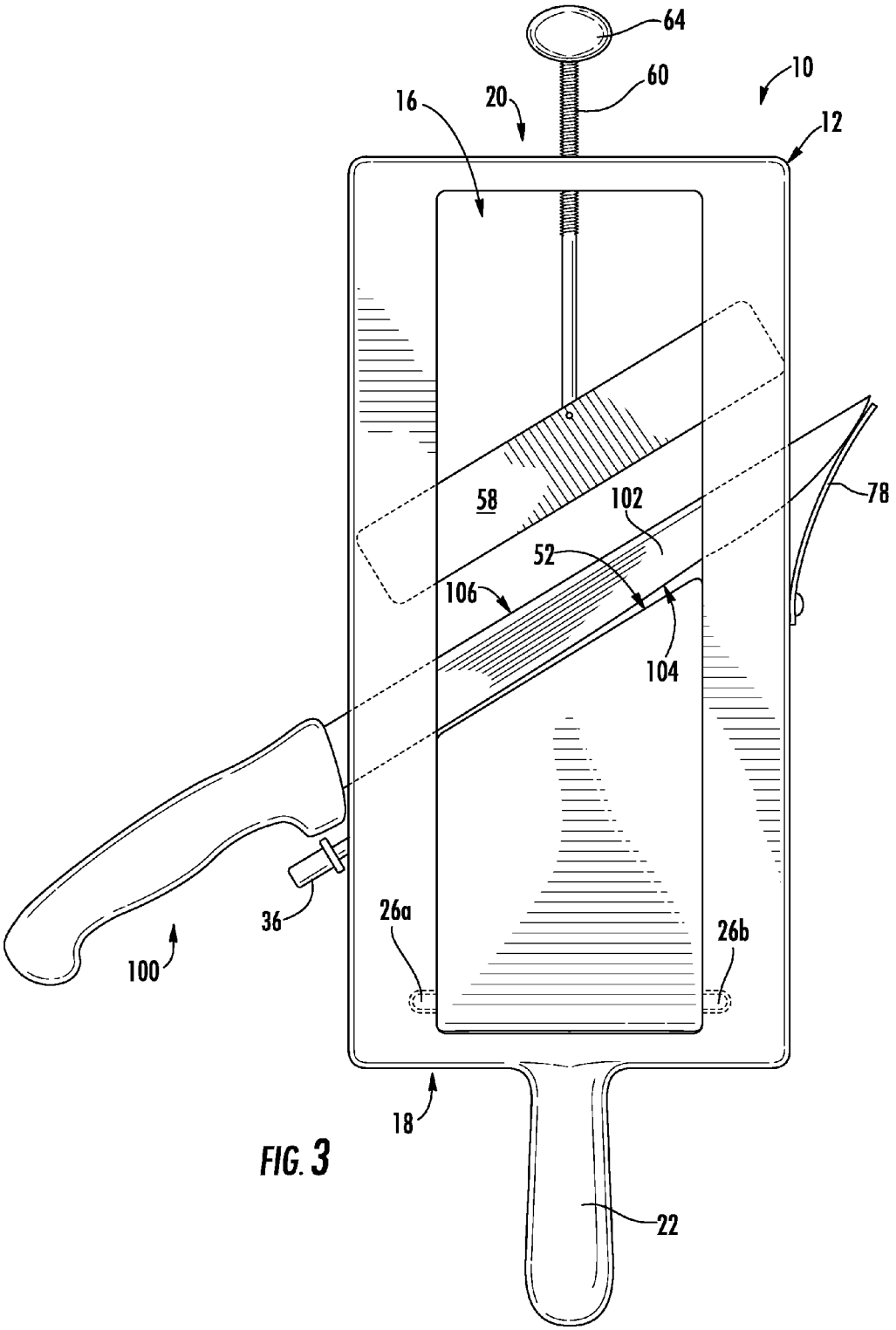
FIG. 3 is plan view of the slicing apparatus of FIG. 1 with a kitchen knife inserted therein and with knife blade locking means in a retracted position.

An additional safety feature of the subject slicing apparatus 10 is the inclusion of a flexible blade guard 78 extending across at least a portion of slot 50*b* of right longitudinal frame member 12*b*. Blade guard 78 comprises a flexible strip of cut resistant material, preferably but not essentially c-shaped in cross-section, mounted to the outer side wall of longitudinal frame member 12*b*. For knives having a blade that extends beyond frame member 12*b* when mounted within slicing apparatus 10 (such as shown in FIGS. 3 and 5), blade guard 78 will cover the exposed portion of the cutting edge 104 to prevent injury. In another embodiment, longitudinal frame member 12*b* may be wider at least in the area of slot 50*b* so as to conceal that portion of longer knife blades that would otherwise extend beyond the outer edge of right longitudinal frame member 12*b*. It should also be appreciated that although the above description teaches a left-side knife mountable slicing apparatus, the design could be reversed for a right-side knife mountable embodiment.

Given that the subject slicing apparatus 10 is used to prepare food, its surfaces and components will become soiled. When it comes to keeping surfaces sanitary, non-porosity is key. Using porous material that can absorb water and subsequently hold onto it increases the chances of cross-contamination from growing bacteria. Moreover, because the surfaces of the subject apparatus will be exposed to food soiling and will require frequent cleaning, said surfaces shall be constructed of a corrosion-resistant, nonabsorbent, and smooth material. Such materials may not allow the migration of deleterious substances or impart colors, odors, or tastes to food and under normal use conditions shall be: safe; durable, corrosion-resistant, and nonabsorbent; sufficient in weight and thickness to withstand repeated warewashing; finished to have a smooth, easily cleanable surface; and resistant to pitting, chipping, crazing, scratching, scoring, distortion, and decomposition.

For example, the subject apparatus may be fabricated from high density polyethylene, a clean, white, high-impact plastic material that is almost unbreakable. As an alternative, the subject apparatus may be fabricated from polypropylene to exhibit very high corrosion-resistance to acidic, alkaline and saline solutions. In this embodiment, the apparatus is satisfactory for service at temperatures up to 250° F. and can be sterilized. The polypropylene construction has high tensile strength and tremendous impact strength and very importantly has virtually no water absorption. Another viable alternative is to fabricate the apparatus from fiberglass which will provide a smooth surface with rounded corners for easy cleaning. Sturdy fiberglass won't dent, chip, bend peel, crack or warp. Fiberglass is suitable for color coding of the apparatus and are impervious to dishwasher temperatures and detergents and resistant to industrial cleaners. It will withstand continuous service from −40° F. to 250° F. with intermittent service as high as 300° F. Other suitable materials may also be employed. Any metallic hardware used in the construction of apparatus 10, such as adjustment rod 60 and adjustment pin 66, are preferably made of stainless steel for its anti-corrosion and strength properties.

Figure 9:
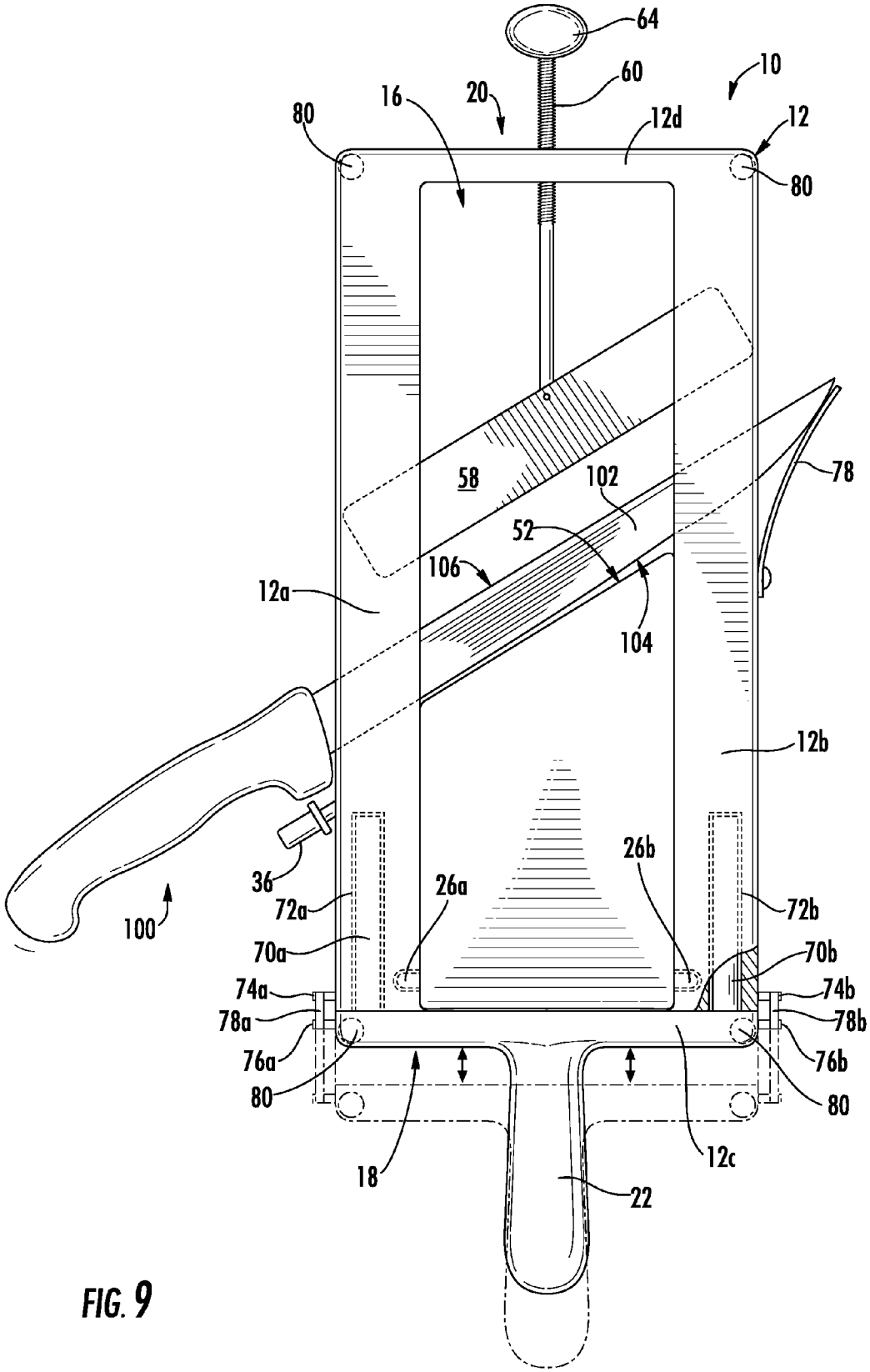
FIG. 9 is a plan view of another embodiment of the subject slicing apparatus having means for mounting to a bowl.
Figure 10:
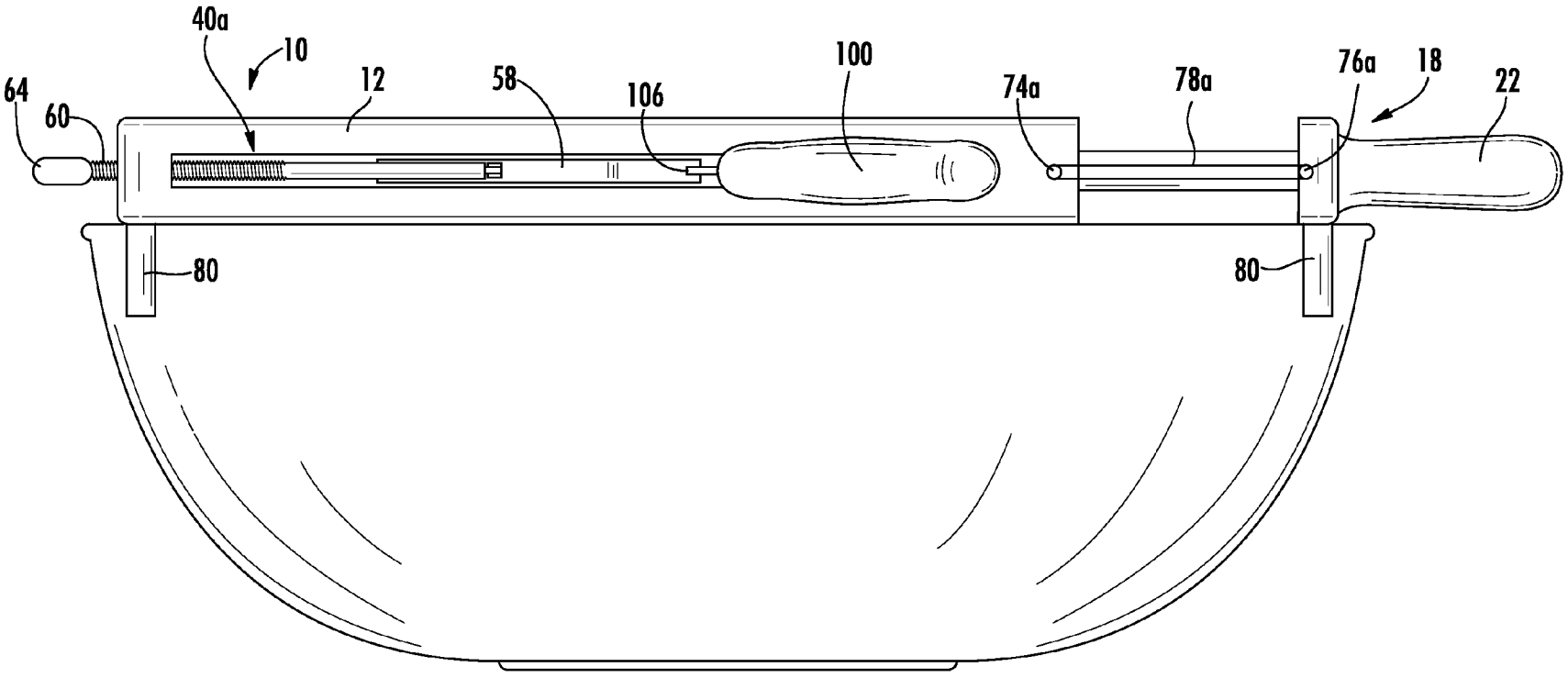
FIG. 10 is a side elevation view of the slicing apparatus of Figure shown mounted to a kitchen bowl.

Referring now to FIGS. 9 and 10, another embodiment of the slicing apparatus of the subject invention is adapted with mounting means for removably mounting the apparatus atop kitchen bowls of a variety of sizes. In such an embodiment, the proximal end 18 of frame body 12 is modified such that proximal cross member 12*c* is slidably attached to longitudinal frame members 12*a*,12*b*, rather than fixedly attached thereto or integrally formed therewith. To accomplish this, in one embodiment, proximal cross member 12 includes left and right slide arms 70*a*,70*b*, respectively, fixedly mounted thereto in perpendicular fashion, one at each of its ends. Left slide arm 70*a* is slidably received within left slide arm receiver 72*a*, and right slide arm 70*b* is slidably received within right slide arm receiver 72*b*. As may be appreciated, proximal cross member 12*c* may be manually moved distally to engage longitudinal frame members 12*a*,12*b* in abutting relationship thereto, or may be pulled away therefrom a distance of several inches (i.e., 2-6 inches), proximally. In order that proximal cross member 12*c* may be normally biased in abutting engagement with longitudinal frame members 12*a*, 12*b*, proximal cross member biasing means are included. In one embodiment, such biasing means is comprised of a left distal band support peg 74*a* fixedly attached to or integrally formed with left longitudinal frame member 12*a*, preferably but not essentially perpendicular to its side wall, and in proximity to proximal end 18, and a corresponding left proximal band support peg 76*a* fixedly attached to or integrally formed with proximal cross member 12*c* in close proximity to left distal band support peg 74*a* in parallel fashion, and an elastic band 78*a* stretched around the two causing them (and the components to which they are attached) to be normally biased together. In another embodiment, a complimentary arrangement is provided on the right side of frame body 12, the arrangement comprising a right distal band support peg 74*b* fixedly attached to or integrally formed with right longitudinal frame member 12*b*, preferably but not essentially perpendicular to its side wall, and in proximity to proximal end 18, and a corresponding right proximal band support peg 76*b* fixedly attached to or integrally formed with proximal cross member 12*c* in close proximity to right distal band support peg 74*b* in parallel fashion, and a second elastic band 78*b* stretched around the two causing them to be normally biased together. Either or both such arrangements may be employed, and those skilled in the art will recognize other biasing means suitable for carrying out this purpose such as, for instance, the use of springs. To complete the mounting means, a plurality of mounting legs 80 depend downwardly in perpendicular fashion from the bottom of frame body 12; one from each of its four corners; two at its proximal end, and two at its, distal end. Each mounting leg 80 may be wrapped in or coated with rubber or similar material having good gripping property. Referring to FIG. 10, mounting of slicing apparatus 10 to a kitchen bowl is accomplished by biasing the proximal and distal mounting legs 80 together around the outside rim of the bowl using the above-described biasing means. For instance, this may be accomplished by pulling proximal cross member 12*c* and the rest of frame body 12 away from one another longitudinally a distance sufficient for all mounting legs to be outside of the rim of the bowl when frame body 12 is mounted across the bowl opening, and then releasing proximal cross member 12*c* and the rest of frame body 12 to allow the biasing means to draw them back together such that all four mounting legs come into frictional engagement with the bowl's outer rim. As may be appreciated, the subject slicing apparatus 10 may thus be "clamped onto" the bowl in order to carry out the heretofore described slicing operation. Mounting legs 80 also serve to elevate slicing apparatus 10 above a resting or work surface such as a countertop.

Although the present invention has been described with reference to the particular embodiments herein set forth, it is understood that the present disclosure has been made only by way of example and that numerous changes in details of construction may be resorted to without departing from the spirit and scope of the invention. Thus, the scope of the invention should not be limited by the foregoing specifications, but rather only by the scope of the claims appended hereto.

What is claimed as being new, useful and desired to be protected by Letters Patent of the United States is as follows:

1. A food slicing apparatus for use in combination with kitchen knife having a blade with a cutting edge, the slicing apparatus comprising:

a. a frame body having a proximal end and a distal end; said frame body comprising a pair of parallel longitudinal frame members joined together at said proximal end by a proximal cross member and at said distal end by a distal cross member; said longitudinal frame members, said proximal cross member and said distal cross member defining a frame opening;

b. a food support plate pivotally mounted within said frame opening about an axis of rotation parallel to said proximal cross member; said food support plate having a proximal end and a distal end; said proximal end being proximate to said proximal cross member and;

c. blade receiving means for receiving the blade of the kitchen knife across said frame opening with the cutting edge of said blade facing said proximal end of said frame body; said blade receiving means comprising a slot disposed through each of said pair of longitudinal frame members; each said slot terminating proximally in a blade stop for engaging the cutting edge of the blade proximate to said distal end of said food support plate; and d. blade securing means comprising:

a) a transverse member in slidable engagement with each said slot of said pair of longitudinal members and across said frame opening; said transverse member being slidable proximally and distally across said opening; and b) adjustment means for adjusting the position of said transverse member proximally and distally within said frame opening and for applying a force on said transverse member proximally for engaging the blade and biasing the cutting edge of the blade against each said blade stop.

2. The food slicing apparatus of claim 1, wherein each said slot is sized and shaped to receive axially therethrough the blade of a variety of differently sized and shaped kitchen knives.

3. The food slicing apparatus of claim 2, wherein said transverse member has a leading edge facing said proximal end of said frame body and a trailing edge facing said distal end of said frame body; said trailing edge having a midpoint; said transverse member being pivotally attached at said midpoint of said trailing edge to said adjustment means; whereby said transverse member is permitted to rotate in order that said leading edge will lie flush with a spine of the blade regardless of the angle of orientation of the spine of the blade relative to the cutting edge of the blade when mounted against said blade stops.

4. The food slicing apparatus of claim 3, wherein said proximal cross member is slidably mounted to said pair of longitudinal frame members to permit longitudinal adjustment of said proximal cross member relative to said longitudinal frame members; the slicing apparatus further including:

a. a first pair of legs depending downwardly in perpendicular fashion from said distal end of said frame body;

b. a second pair of legs depending downwardly in perpendicular fashion from said proximal cross member; and c. biasing means for biasing said first pair of legs and said second pair of legs together;

whereby the slicing apparatus may be mounted across an opening of a bowl having an outer rim by biasing said first pair of legs and said second pair of legs against the outer rim of the bowl in frictional engagement therewith.

5. The food slicing apparatus of claim 2, further including a transverse support rod rotatably mounted across said frame opening and under said distal end of said food support plate; said support rod having an irregular cross-sectional shape such that axial rotation of said support rod permits incremental height adjustment of said food support plate relative to the cutting edge of the blade when mounted in said blade receiving means.

6. The food slicing apparatus of claim 5, wherein said proximal cross member is slidably mounted to said pair of longitudinal frame members to permit longitudinal adjustment of said proximal cross member relative to said longitudinal frame members; the slicing apparatus further including:

a. a first pair of legs depending downwardly in perpendicular fashion from said distal end of said frame body;

b. a second pair of legs depending downwardly in perpendicular fashion from said proximal cross member; and c. biasing means for biasing said first pair of legs and said second pair of legs together;

whereby the slicing apparatus may be mounted across an opening of a bowl having an outer rim by biasing said first pair of legs and said second pair of legs against the outer rim of the bowl in frictional engagement therewith.

7. The food slicing apparatus of claim 2, wherein said proximal cross member is slidably mounted to said pair of longitudinal frame members to permit longitudinal adjustment of said proximal cross member relative to said longitudinal frame members; the slicing apparatus further including:

a. a first pair of legs depending downwardly in perpendicular fashion from said distal end of said frame body;

b. a second pair of legs depending downwardly ire perpendicular fashion from said proximal cross member; and c. biasing means for biasing said first pair of legs and said second pair of legs together;

whereby the slicing apparatus may be mounted across an opening of a bowl having an outer rim by biasing said first pair of legs and said second pair of legs against the outer rim of the bowl in frictional engagement therewith.

8. The food slicing apparatus of claim 1, wherein said transverse member has a leading edge facing said proximal end of said frame body and a trailing edge facing said distal end of said frame body; said trailing edge having a midpoint; said transverse member being pivotally attached at said midpoint of said trailing edge to said adjustment means; whereby said transverse member is permitted to rotate in order that said leading edge will lie flush with a spine of the blade regardless of the angle of orientation of the spine of the blade relative to the cutting edge of the blade when mounted against said blade stops.

9. The food slicing apparatus of claim 8, further including a transverse support rod rotatably mounted across said frame opening and under said distal end of said food support plate; said support rod having an irregular cross-sectional shape such that axial rotation of said support rod permits incremental height adjustment of said food support plate relative to the cutting edge of the blade when mounted in said blade receiving means.

10. The food slicing apparatus of claim 9, wherein said proximal cross member is slidably mounted to said pair of longitudinal frame members to permit longitudinal adjustment of said proximal cross member relative to said longitudinal frame members; the slicing apparatus further including:

a. a first pair of legs depending downwardly in perpendicular fashion from said distal end of said frame body;

b. a second pair of legs depending downwardly in perpendicular fashion from said proximal cross member; and c. biasing means for biasing said first pair of legs and said second pair of legs together;

whereby the slicing apparatus may be mounted across an opening of a bowl having an outer rim by biasing said first pair of legs and said second pair of legs against the outer rim of the bowl in frictional engagement therewith.

11. The food slicing apparatus of claim 8, wherein said proximal cross member is slidably mounted to said pair of longitudinal frame members to permit longitudinal adjustment of said proximal cross member relative to said longitudinal frame members; the slicing apparatus further including:

d. a first pair of legs depending downwardly in perpendicular fashion from said distal end of said frame body;

e. a second pair of legs depending downwardly in perpendicular fashion from said proximal cross member; and f. biasing means for biasing said first pair of legs and said second pair of legs together;

whereby the slicing apparatus may be mounted across an opening of a bowl having an outer rim by biasing said first pair of legs and said second pair of legs against the outer rim of the bowl in frictional engagement therewith.

12. The food slicing apparatus of claim 1, further including a transverse support rod rotatably mounted across said frame opening and under said distal end of said food support plate; said support rod having an irregular cross-sectional shape such that axial rotation of said support rod permits incremental height adjustment of said food support plate relative to the cutting edge of the blade when mounted in said blade receiving means.

13. The food slicing apparatus of claim 12, wherein said transverse member has a leading edge facing said proximal end of said frame body and a trailing edge facing said distal end of said frame body; said trailing edge having a midpoint; said transverse member being pivotally attached at said midpoint of said trailing edge to said adjustment means; whereby said transverse member is permitted to rotate in order that said leading edge will lie flush with a spine of the blade regardless of the angle of orientation of the spine of the blade relative to the cutting edge of the blade when mounted against said blade stops.

14. The food slicing apparatus of claim 13, wherein said proximal cross member is slidably mounted to said pair of longitudinal frame members to permit longitudinal adjustment of said proximal cross member relative to said longitudinal frame members; the slicing apparatus further including:

a. a first pair of legs depending downwardly in perpendicular fashion from said distal end of said frame body;

b. a second pair of legs depending downwardly in perpendicular fashion from said proximal cross member; and c. biasing means for biasing said first pair of legs and said second pair of legs together;

whereby the slicing apparatus may be mounted across an opening of a bowl having an outer rim by biasing said first pair of legs and said second pair of legs against the outer rim of the bowl in frictional engagement therewith.

15. The food slicing apparatus of claim 12, wherein said proximal cross member is slidably mounted to said pair of longitudinal frame members to permit longitudinal adjustment of said proximal cross member relative to said longitudinal frame members; the slicing apparatus further including:

a. a first pair of legs depending downwardly in perpendicular fashion from said distal end of said frame body;

b. a second pair of legs depending downwardly in perpendicular fashion from said proximal cross member; and c. biasing means for biasing said first pair of legs and said second pair of legs together;

whereby the slicing apparatus may be mounted across an opening of a bowl having an outer rim by biasing said first pair of legs and said second pair of legs against the outer rim of the bowl in frictional engagement therewith.

16. The food slicing apparatus of claim 1, wherein said proximal cross member is slidably mounted to said pair of longitudinal frame members to permit longitudinal adjustment of said proximal cross member relative to said longitudinal frame members; the slicing apparatus further including:

a. a first pair of legs depending downwardly in perpendicular fashion from said distal end of said frame body;

b. a second pair of legs depending downwardly in perpendicular fashion from said proximal cross member; and c. biasing means for biasing said first pair of legs and said second pair of legs together;

whereby the slicing apparatus may be mounted across an opening of a bowl having an outer rim by biasing said first pair of legs and said second pair of legs against the outer rim of the bowl in frictional engagement therewith.

* * * * *